United States Patent [19]

Binder et al.

[11] Patent Number: 4,816,080

[45] Date of Patent: Mar. 28, 1989

[54] METHOD OF WASHING SOLIDS WITH LIQUIFIED GASES

[75] Inventors: Michael Binder, Brooklyn, N.Y.; Charles W. Walker, Jr., Neptune, N.J.; Robert J. Mammone, South Plainfield, N.J.; William L. Wade, Jr., Neptune, N.J.; Sol Gilman, Rumson, N.J.

[73] Assignee: The United States of America as represented by the Secretary of the Army, Washington, D.C.

[21] Appl. No.: 913,794

[22] Filed: Sep. 29, 1986

[51] Int. Cl.[4] ..... B08B 7/04

[52] U.S. Cl. ..... 134/10; 134/11; 134/33; 134/39; 34/133; 34/134

[58] Field of Search ..... 134/10, 11, 31, 39, 134/5; 34/133, 134

[56] References Cited

U.S. PATENT DOCUMENTS 4,536,222 8/1985 Settineri et al. ..... 134/31

*Primary Examiner*—H. M. S. Sneed
*Assistant Examiner*—Sharon T. Cohen
*Attorney, Agent, or Firm*—Sheldon Kanars; Roy E. Gordon

[57] ABSTRACT

Solid materials are easily washed with liquified gas by placing the solid material to be washed in a dry vessel under an inert atmosphere, evacuating the vessel, introducing the low temperature liquified gas solvent into the vessel, allowing the washing of the solid by the liquified gas solvent, and removing the solvent by the application of vacuum.

2 Claims, 1 Drawing Sheet

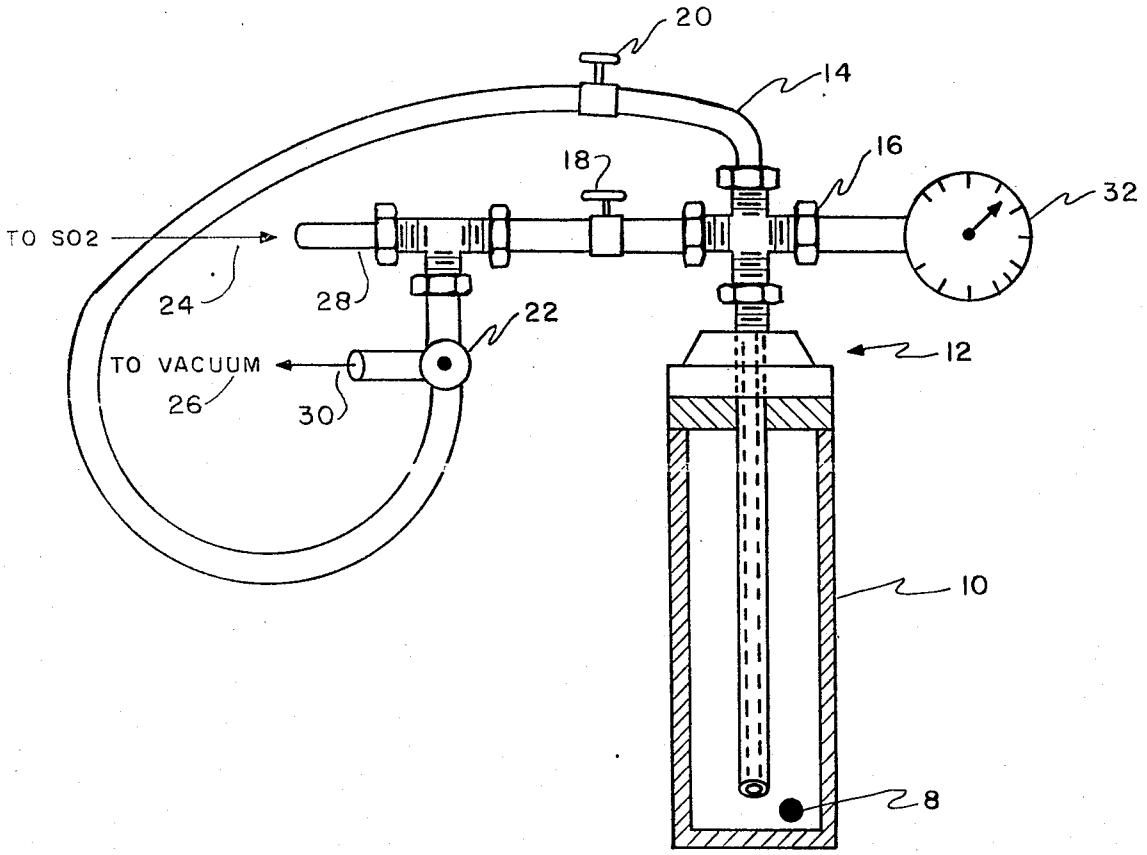
32
16
14
20
18
22
28
24
TO SO2
TO VACUUM
26
30
12
10
8

METHOD OF WASHING SOLIDS WITH LIQUIFIED GASES

The invention described herein may be manufactured, used and licensed by or for the Government for governmental purposes without the payment to us of any royalty thereon.

This invention relates in general to a method of washing solid materials and in particular to such a method wherein the washing solvent is a liquified gas such as sulfur dioxide.

BACKGROUND OF THE INVENTION

In many applications involving extractions or separations, the solids to be cleaned are rinsed or washed with solvents. Complications arise when the solids are air or moisture sensitive and the extracting liquids are liquified gases such as sulfur dioxide. For example, sulfur dioxide is a liquid only at temperatures below −10 C. If one wanted to use sulfur dioxide as a wash solution, unwanted moisture could easily condense and enter into the liquid and provide additional opportunity for contamination. This would be a serious problem even if the experiment could be conducted in a low humidity dry room. The water vapor present in low concentrations would condense into the cold liquid and thus react with the solid sample.

SUMMARY OF THE INVENTION

The general object of this invention is to provide a method of washing solids with liquified gases without contamination from outside air or moisture. A further object is to provide such a method wherein the washing solvent is a moisture sensitive liquid having relatively high vapor pressures at room temperature. A particular object of the invention is to provide such a method where the washing solvent is liquified sulfur dioxide.

It has now been found that the aforementioned objects can be attained by a method including the steps of:

(A) placing the solid to be washed in a dry vessel under an inert atmosphere, (B) evacuating the vessel, (C) introducing the liquified gas solvent into the vessel, (D) washing the solid with the liquified gas solvent, and (E) removing the solvent by the application of vacuum.

DESCRIPTION OF THE DRAWING AND PREFERRED EMBODIMENT

The drawing illustrates the method of the invention including wash equipment that can be used in carrying out the invention.

Referring to the drawing, the solid to be washed, 8, is placed at the bottom of a glass pressure container or cell, 10, which can be sealed by means of screw cap, 12, thus making cell, 10, capable of maintaining high pressures. Screw cap, 12, is connected by means of Teflon tubing, 14, through a union cross, 16, to valves 18, 20 and 22 thus sealing the entire assembly.

Valves 18, 20 and 22 extend by means of Teflon tubing, 14, to an inlet port, 24, for admission of the liquid wash solution, and another port, 26, through which vacuum can be provided for the entire system.

Quick connect adapters, 28, and 30, connect to inlet ports 24, and 26 respectively.

Valve, 18, is a two way valve which regulates the flow of liquid from port 24. When in the open positon, valve 18 allows liquid to flow into cell 10. When in the closed position, no liquid can enter cell 10. Valve 20 is also a two way valve connecting cell 10 to valve 22. Valve 20 regulates the vacuum being applied to cell 10, when in the open position.

Valve 22 is a three way valve connected to a means of evacuation such as a vacuum pump (not shown). The up position shunts vacuum to valve 20 and through connecting Teflon tubing 14. In the down position, valve 22 shunts vacuum to valve 18. This action evacuates the line from port 26 through inlet port 24 up to valve 18. In the center position valve 22 isolates vacuum port 26 from the entire assembly.

An optional pressure gauge, 32, attached to union cross, 16, allows for pressure monitoring in order to insure that pressures are maintained below safety limits.

In carrying out the method of the invention, the solids, 8, to be washed are first placed at the bottom of cell 10 while either in a dry room or dry box and screw cap, 12, is tightened. Valves 18, 20, and 22 remain closed. Quick connects 28, and 30, are then attached to the inlet port, 24, for the admission of liquid wash solution and the vacuum providing port, 26, respectively. In the case when the inlet port, 24 is for the admission of liquified sulfur dioxide, a tank of gaseous $SO_2$ is fitted with an eductor tube or a tube extending down to the bottom liquified portion of the $SO_2$ (not shown) so that pure liquid is removed. Valve 22, is first rotated to the upper position to evacuate any air or moisture that may be trapped in the tubes from the sulfur dioxide tank to valve 18. After this region is fully evacuated, valve 22 is rotated downwards so that the applied vacuum evacuates the region from port 26 to valve 20. Valve 20 is then opened to fully evacuate cell, 10. At this point, valves 22 and 20 are closed and valve 18 is opened to allow pure liquid to enter the cell, 10. Valve 18 is then closed. The solids to be extracted or cleaned are stirred and the spent liquid is then removed by rotating valve 22 downwards and opening valve 20 to withdraw liquid through valve 22 to port 26. Teflon tubing 14, extends close to the bottom of cell 10 as shown in the drawing. This is important. If tubing 14, does not extend to close to the bottom of cell 10, the wash liquid alone will be removed by evaporation leaving dissolved materials behind. By extending tube 14 to close to the bottom of the cell 10, the liquid and the solids dissolved in it will be evacuated together from cell 10 through vacuum port 26.

The foregoing wash procedure can be repeated any number of times until all of the impurities or extractable materials are removed. Cell 10 can then be disconnected and taken into a dry room or box for subsequent processing.

In carrying out the method of the invention, in lieu of liquified sulfur dioxide as the wash solvent, other liquified gases such as liquid ammonia, liquid nitrogen, or liquid oxygen can be used. In fact, the wash solvent can be any material that is a liquid under pressure. This includes pressurized non aqueous solvents.

The wash solvent can also be a moisture sensitive liquid having a relatively high vapor pressure such as thionyl chloride or sulfuryl chloride.

Any solid material can be washed using the method of the invention. The method works particularly well when washing a porous carbon cathode to be used in an electrochemical cell. In such a case, the cathode would be washed to remove organic impurities introduced into the carbon during the manufacturing process or to selectively remove desired products from the carbon.

We wish it to be understood that we do not desire to be limited to the exact details as described for obvious modifications will occur to a person skilled in the art.

What is claimed is:

1. Method of washing solids in a liquefied gas solvent wherein the washing solvent is a moisture sensitive liquid having relatively high vapor pressures at room temperature, said method including steps of:

A. placing the solid to be washed in a dry vessel under an inert atmosphere,

B. evacuating the vessel,

C. introducing the liquefied gas solvent into the vessel,

D. allowing the washing of the solid by the liquefied gas solvent and repeating the washing any number of times until all of the impurities are removed, and E. removing the liquefied gas solvent together with dissolved solids by application of vacuum.

2. Method according to claim 1 wherein the liquified gas solvent is sulfur dioxide.

* * * * *